US008196633B2

(12) United States Patent
You

(10) Patent No.: US 8,196,633 B2
(45) Date of Patent: Jun. 12, 2012

(54) CORRECTION TAPE APPLICATOR

(75) Inventor: Kwang Ho You, Incheon (KR)

(73) Assignee: Dong Kee Enterprise Co., Ltd., Incheon (KR)

( * ) Notice: Subject to any disclaimer, the term of this patent is extended or adjusted under 35 U.S.C. 154(b) by 175 days.

(21) Appl. No.: 12/608,139

(22) Filed: Oct. 29, 2009

(65) Prior Publication Data

US 2010/0108269 A1 May 6, 2010

(30) Foreign Application Priority Data

Oct. 30, 2008 (KR) ..... 10-2008-0107307

(51) Int. Cl.
*B32B 37/26* (2006.01)
*B26F 3/02* (2006.01)
*B43L 19/00* (2006.01)

(52) U.S. Cl. ..... 156/577; 156/527; 156/579; 118/76; 118/200; 118/257; 242/588; 242/588.3; 242/588.6; 242/160.2; 242/160.4; 242/170; 242/171; 206/411

(58) Field of Classification Search ..... 156/523, 156/527, 538, 540, 574, 577, 579; 118/76, 118/200, 257; 225/46; 242/160.2, 160.4, 242/170, 171, 588, 588.2, 588.3, 588.6; 206/411
See application file for complete search history.

(56) References Cited

U.S. PATENT DOCUMENTS

| | | | | |
|---|---|---|---|---|
| 5,707,482 | A * | 1/1998 | Fusselman | 156/577 |
| 6,550,518 | B1 * | 4/2003 | Lee | 156/577 |
| 6,599,363 | B2 * | 7/2003 | Narita | 118/76 |
| 2003/0205332 | A1 * | 11/2003 | Shinya | 156/577 |
| 2004/0028461 | A1 * | 2/2004 | Watanabe et al. | 401/195 |
| 2008/0168944 | A1 * | 7/2008 | Narita | 118/257 |
| 2008/0173406 | A1 * | 7/2008 | Wu | 156/540 |
| 2009/0159217 | A1 * | 6/2009 | Sun | 156/540 |
| 2011/0000623 | A1 * | 1/2011 | Wu | 156/579 |

* cited by examiner

*Primary Examiner* — Mark A Osele
(74) *Attorney, Agent, or Firm* — Kile Park Goekjian Reed & McManus PLLC

(57) ABSTRACT

Disclosed herein is a correction tape applicator or a transfer tape dispenser which is adapted to be used to correct markings, for example, such as characters, numerals, and the like recorded on a sheet of paper, or adhere sheets of paper to each other. According to the correction tape applicator of the present invention, a tape cartridge directly applied to the application work is completely protectively accommodated within a casing so that it can be used more stably for a long time period to improve durability to thereby achieve economic efficiency. Also, the tape cartridge can be easily disengaged from and engaged with the casing to enhance convenience of use, and an opening/closing space of a cover can be minimized to achieve miniaturization of the casing.

3 Claims, 15 Drawing Sheets

CORRECTION TAPE APPLICATOR

BACKGROUND OF THE INVENTION

1. Field of the Invention

The present invention relates to a correction tape applicator or a transfer tape dispenser which is adapted to be used to correct markings, for example, such as characters, numerals, and the like recorded on a sheet of paper, or adhere sheets of paper to each other. More particularly, the present invention relates to a correction tape applicator in which a tape cartridge accommodated in a casing is constructed in such a fashion as to be advanced from and retracted into the casing by means of a pressing means, and the tape cartridge and the pressing means are releasably engaged with each other.

2. Background of the Related Art

In general, it is well known that a conventional correction tape applicator has a construction in which an adhesive application layer or a correction fluid (hereinafter, referred to "coating material") coated on a surface of a carrier tape is transferred and applied to a corresponding surface of a sheet of paper in order to correct markings, for example, such as generally small characters, numerals, figures and the like recorded on the sheet of paper, or adhere sheets of paper (including all kinds of paper bags) to each other, so that correction or adhesion is performed.

Such a conventional correction tape applicator is configured such that a correction tape having the carrier tape on which the coating material is coated is rollingly wound around on a supply spool included in a casing having a predetermined shape, and then is withdrawn through a withdrawal opening formed at a front end of the casing via a predetermined path of travel so that the coating material coated on the carrier tape is applied to a to-be-applied surface of the sheet of paper.

However, the conventional correction tape applicator has a disadvantageous construction in which the coating material-coated carrier tape unwound from the supply spool always is in a state of being withdrawn through the withdrawal opening formed at the front end of the casing so as to be externally exposed irrespective of before or after the use of the applicator.

For this reason, foreign substances such as fine dust particles adhere to the surface of the externally exposed coating material of the carrier tape, which contributes to a degradation of the intrinsic function of the coating material. In addition, the long-term exposure of the coating material to the outside causes damage due to the foreign substances as well as deformation of the coating material, i.e., evaporation and hardening of a correction fluid or an adhesive material, making it impossible to use the correction tape. As a result, the correction tape applicator must be replaced with a new one, which imposes an economic loss on a user.

SUMMARY OF THE INVENTION

Therefore, the present invention has been made in view of the above problems, and it is an object of the present invention to provide a correction tape applicator in which a tape cartridge directly applied to the application work is completely protectively accommodated within a casing so that it can be used more stably for a long time period to improve durability to thereby achieve economic efficiency, the tape cartridge can be easily disengaged from and engaged with the casing to enhance convenience of use, and an opening/closing space of a cover can be minimized to achieve miniaturization of the casing.

In order to accomplish the above object, in one aspect, the present invention provides a correction tape applicator including: a casing including a hollow main body and a cover, the main body having an internal space portion of a predetermined dimension, the main body being opened at both ends thereof to form front and rear openings so as to allow the internal space portion to fluidically communicate with the outside, and the cover having an internal space portion, the cover being opened at both ends thereof and being pivotally hinged to one end of the main body so as to open and close the rear opening formed at the one end of the main body; a tape cartridge formed in various dimensions and shapes and removably accommodated in the internal space portion of the main body, the tape cartridge including at least two spools for winding a unused carrier tape coated with a coating material to be applied to a to-be-applied surface so that the carrier tape can be withdrawn and a used carrier tape not coated with the coating material, and a plurality of gears for driving the spools; pressing means adapted to be movably inserted into the internal space portion of the casing cover by means of an elastic force of elastic members so that the pressing means is connected at one end thereof to a rear end of the tape cartridge and is externally protruded from the casing cover at the other end thereof in such a fashion as to be pressed, the pressing means being adapted to impart a force necessary for allowing a part of the tape cartridge to be externally protruded from the front opening of the main body so that the coating material of the carrier tape can be applied to the to-be-applied surface or allowing the tape cartridge to return to its original position of the internal space portion of the casing depending on whether or not the externally protruded portion of the pressing means is pressed; and engagement and disengagement means mounted at the opposed confronting ends of the pressing means and the tape cartridge so as to allow the pressing means and the tape cartridge to be releasably and fittingly engaged with each other therethrough such that the pressing means and the tape cartridge are disengaged from each other or engaged with each other depending on whether the casing cover is opened or closed.

Preferably, the engagement and disengagement means may include: a protrusion formed on one end surface of the opposed confronting ends of the pressing means and the tape cartridge in such a fashion as to be formed as a protruding piece having a round shape in the cross-section at a distal end thereof; and a fitting indentation formed on the other end surface of the opposed confronting ends of the pressing means and the tape cartridge in such a fashion as to be defined by a pair of opposed protruding pieces formed in a round shape in the cross-section at distal ends thereof so as to be spaced apart from each other by a predetermine interval to thereby elastically support the protrusion, such that the protrusion is disengaged from or engaged with the fitting indentation depending on whether the casing cover is opened or closed.

Also, preferably, the tape cartridge may include a housing having a body composed of two half-bodies for accommodating the two spools therein, and a guide tip disposed at a front end of the housing for providing a path of travel of the carrier tape.

In addition, preferably, the coating material of the carrier tape may be any one of an adhesive material for adhering sheets of paper to each other or a correction fluid for correcting markings such as characters and the like recorded on a sheet of paper.

In order to accomplish the above object, in another aspect, the present invention provides a correction tape applicator including: a casing including a hollow main body and a cover, the main body having an internal space portion of a predetermined dimension, the main body being opened at both ends thereof to form front and rear openings so as to allow the internal space portion to fluidically communicate with the outside, and the cover being pivotally hinged to one end of the main body so as to open and close the rear opening formed at the one end of the main body; engagement means including a pair of opposed engagement apertures formed at both surfaces of the main body and a pair of opposed engagement lugs formed at front ends of opposed elastic arms formed at both surfaces of the cover so that the engagement lugs can be lockingly engaged with the engagement apertures; and a tape cartridge formed in various dimensions and shapes and removably accommodated in the internal space portion of the main body, the tape cartridge including at least two spools for winding a unused carrier tape coated with a coating material to be applied to a to-be-applied surface so that the carrier tape can be withdrawn and a used carrier tape not coated with the coating material, and a plurality of gears for driving the spools.

Preferably, the correction tape applicator further may include a protective piece mounted in proximity to the front opening of the main body in such a fashion as to be advanced from and retracted into the main body through the front opening 212*a* so as to protect the carrier tape coated with the coating material.

DETAILED DESCRIPTION OF THE PREFERRED EMBODIMENT

The preferred embodiments of the invention will be hereinafter described in more detail with reference to the accompanying drawings.

Figure 1:
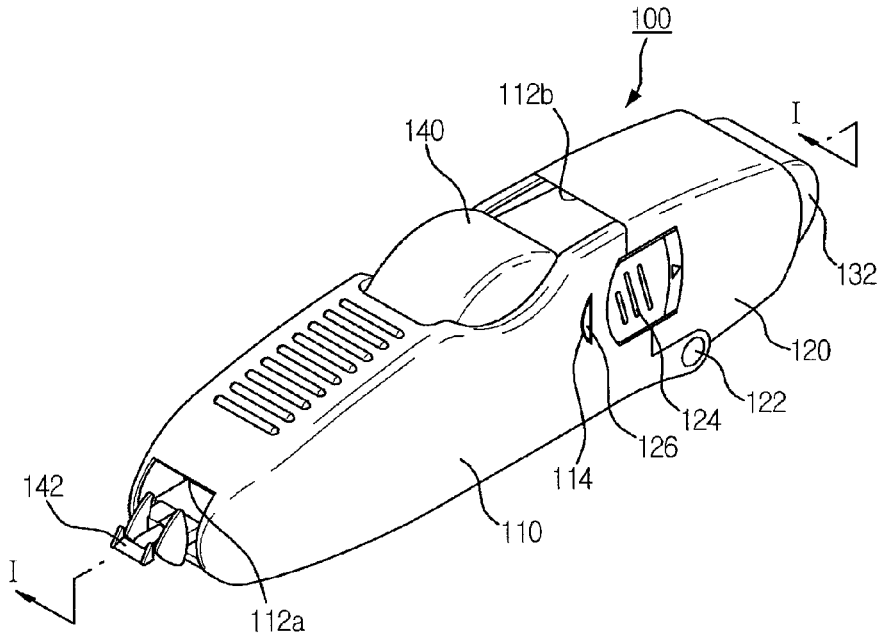
FIG. 1 is a perspective view illustrating a correction tape applicator according to a first embodiment of the present invention.
Figure 2:
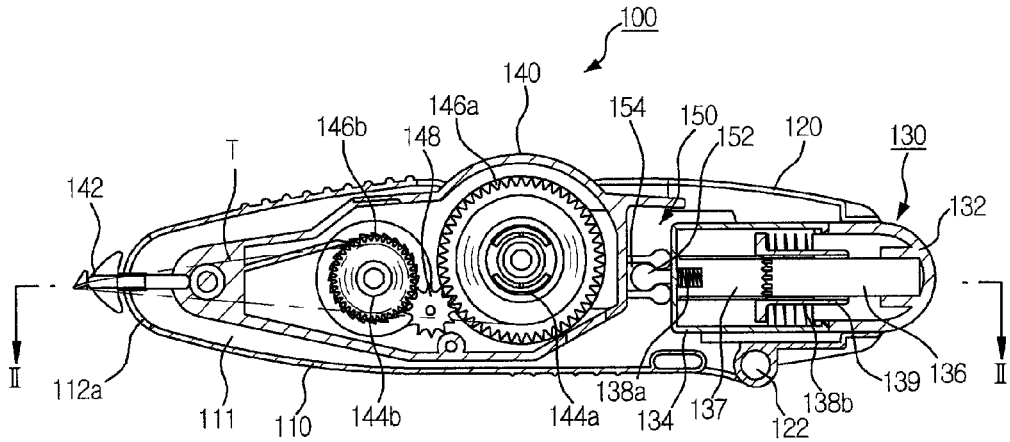
FIG. 2 is a cross-sectional view taken along the line I-I of FIG. 1.
Figure 3:
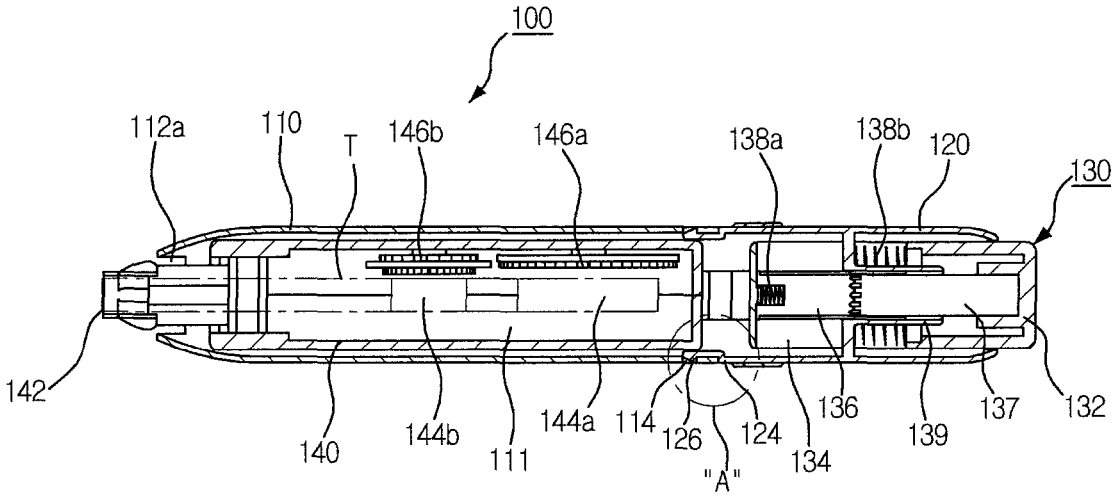
FIG. 3 is a cross-sectional view taken along the line II-II of FIG. 2.
Figure 4:
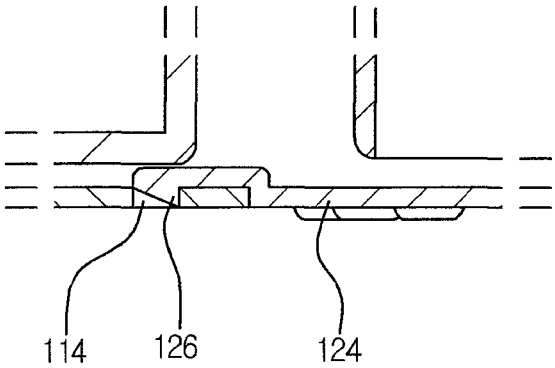
FIG. 4 is an enlarged view of a portion "A" of FIG. 3.
Figure 5:
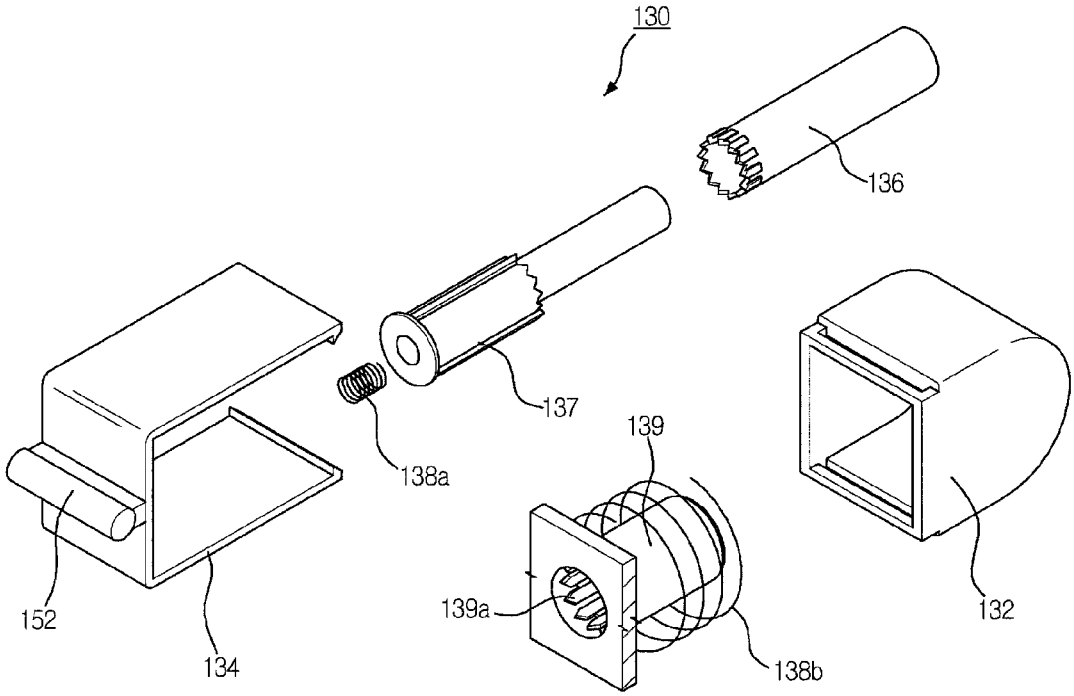
FIG. 5 is an enlarged exploded perspective view illustrating a pressing means 130 of FIG. 2.
Figure 6:
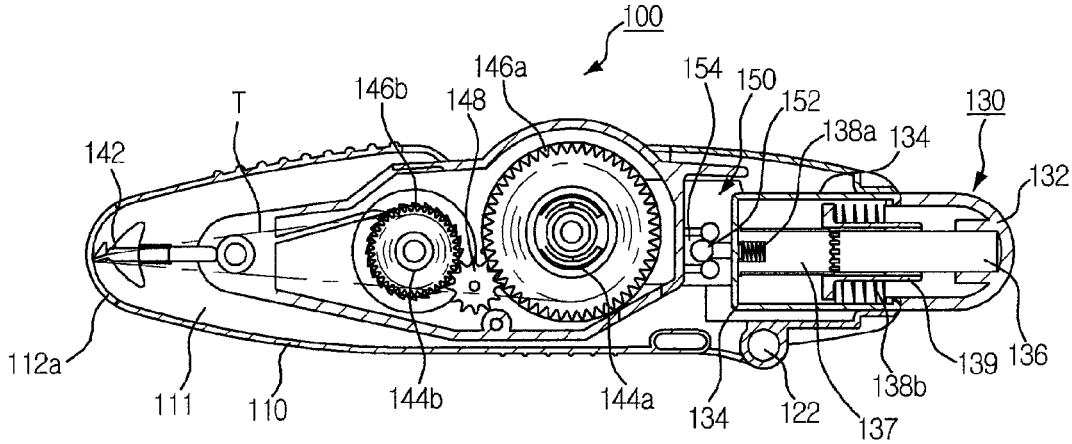
FIG. 6 is a cross-sectional view illustrating a state in which a tape cartridge 140 shown in FIG. 2 is completely accommodated and kept in custody in a casing 120.

FIG. 1 is a perspective view illustrating a correction tape applicator according to a first embodiment of the present invention, FIG. 2 is a cross-sectional view taken along the line I-I of FIG. 1, FIG. 3 is a cross-sectional view taken along the line II-II of FIG. 2, FIG. 4 is an enlarged view of a portion "A" of FIG. 3, FIG. 5 is an enlarged exploded perspective view illustrating a pressing means 130 of FIG. 2, and FIG. 6 is a cross-sectional view illustrating a state in which a tape cartridge 140 shown in FIG. 2 is completely accommodated and kept in custody in a casing 120.

As shown in FIGS. 1 to 6, the correction tape applicator 100 according to the first embodiment of the present invention includes a casing. Referring to FIG. 1, the casing includes a main body 110 and a cover 120.

The main body 110 defines an internal space portion 111 of a predetermined dimension for accommodating a tape cartridge 140 in which a carrier tape T coated with a coating material is wound. The carrier tape T is formed in various sizes. The main body 110 has front and rear openings 112*a* and 112*b* formed at the front and rear ends thereof so as to allow the internal space portion 111 to fluidically communicate with the outside. The front opening 112*a* is used as a withdrawal opening for allowing a guide tip 142 formed at a front end of the tape cartridge 140 disposed within the main body 10 to be externally protruded therethrough. Also, the rear opening 112*b* is used as an insertion opening for allowing the tape cartridge 140 to be inserted into the internal space portion 111 therethrough. In addition, the main body 110 includes a pair of opposed engagement apertures 114 formed at both sides thereof. The opposed engagement apertures 114 serve to allow a cover 120 to be securely engaged with the main body 110. The cover 120 is hingeably coupled to the main body so that it can be opened and closed at the rear opening 112*b*.

As shown in the drawings, the cover 120 is pivotally mounted to a rear end of the main body 110 by means of a hinge shaft 122 so as to open and close the rear opening 112*b* of the main body 110. Further, the cover 120 includes a pair of opposed elastic arms 124 formed at both sides thereof. The opposed elastic arms 124 is intended to allow the cover 120 to be easily disengaged from and engaged with the main body 110. Each of the elastic arms 124 has an engagement lug 126 formed at a front end thereof so as to allow the engagement lugs 126 to be lockingly engaged with the engagement apertures 114 formed at the both sides of the main body 110 so that the cover 120 and the main body are securely engaged with each other.

Also, as shown in the drawings, the correction tape applicator 100 according to the first embodiment of the present invention includes a pressing means 130. The pressing means 130 is in detail shown in FIG. 5. The pressing means 130 includes a push-type knob 132 protrudingly installed at the rear end of the cover 120. A knock member 134 is coupled to one side of the push-type knob 132 so that it is positioned within the cover 120. A cam guide 139 is insertedly mounted in the knock member 134 and the push-type knob 132 so that a knock pin 136 and a rotary cam 137 sustain a predetermined tension by means of first and second springs 138*a* and 138*b*. The cam guide 139 is disposed within the cover 120. The pressing means 130 allows the knock pin 136 to be advanced and retracted by a pressing force of the push-type knob 132 and a restoring force of the first and second springs 138*a* and 138*b*, and allows the rotary cam 137 to rotate while being advanced and retracted by means of the cam guide 139 so as to be fixed at the advanced and retracted position. To this end, the cam guide 139 has a guide hole 139*a* having a predetermined shape formed on the inner peripheral surface thereof. The construction of the pressing means 130 is a typical technology widely used in a knock-type ballpoint pen, etc.

As shown in the drawings, the correction tape applicator 100 includes a tape cartridge 140. The tape cartridge 140 is mounted in the internal space portion 111 of the main body 110 so that it can be advanced and retracted by the pressing means 130. The guide tip 142 formed at the front end of the tape cartridge 140 enters or exits the main body through the front opening 112*a* of the main body 110. The tape cartridge 140 is constructed such that it is inserted into the internal space portion 111 of the main body 110 through the rear opening 112*b* so that only the guide tip 142 of the tape cartridge 140 enters or exits the front opening 112*a* of the main body.

Moreover, a carrier tape coated with a coating material (adhesive material or correction fluid) is disposed within the tape cartridge 140 such that it is traveled on the guide tip 142 via a predetermined path of travel. Mounted within the tape cartridge 140 are a first spool 144*a* as a supply spool on which a unused opaque carrier tape T is wound and a second spool 144*b* as a return spool on which a used transparent carrier tape T is wound. A first gear 146*a* is connected to the first spool 144*a*, and a second gear 146*b* is connected to the second spool 144*b*. The first spool 144*a* and the second spool 144*b* rotate in an opposite direction to each other by means of a pinion gear 148. That is, a rotational force of the first gear 146*a* mounted in the tape cartridge 140 is transmitted to the second gear 146*b* by the pinion gear 148 so as to rotate the second gear 146*b*. Thus, the unused opaque carrier tape T wound on the first spool 144*a* is traveled on the guide tip 142 via a predetermined path of travel so that a coating material layer of the carrier tape T is applied to a to-be-applied surface, and the used transparent carrier tape T is wound on the second spool 144*b*. The dimension (width) of carrier tape (adhesive tape or correction tape) T disposed within the tape cartridge 140 can be set variously.

As shown in the drawings, the correction tape applicator 100 according to the first embodiment of the present invention includes an engagement and disengagement means 150. The engagement and disengagement means 150 allows the tape cartridge 140 and the knock member 134 of the pressing means 130 to be engaged with each other or disengaged from each other. A protrusion 152 is formed on one surface of the tape cartridge 140 or one surface of the knock member 134 confronting the one surface of the tape cartridge and a fitting indentation 154 is formed on the other surface of the tape cartridge 140 or the knock member 134 to allow the protrusion 152 to be fittingly engaged with the fitting indentation 154. Thus, the engagement and disengagement between the protrusion 152 and the fitting indentation 154 allows the tape cartridge 140 and the knock member 134 to be releasably engaged with each other.

The tape cartridge 140 disposed within the main body 110 is stably supported by the engagement between the protrusion 152 and the fitting indentation 154 of the engagement and disengagement means 150 so as to more stably perform the advancement and retraction, i.e., the forward and backward movement of the tape cartridge 140 through the front opening 112*a* by the pressing means 130. In the above embodiment, as one example, it has been illustrated that the protrusion 152 is formed at the knock member 134 of the pressing means 130 and the fitting indentation 154 is formed at the tape cartridge 140.

The protrusion 152 is formed at one surface of the knock member 134 in such a fashion that it is formed as a protruding piece having a round shape in the cross-section at a distal end thereof and formed integrally with the knock member 134. The fitting indentation 154 is defined by a pair of opposed protruding pieces formed in a round shape in the cross-section at distal ends thereof so as to be spaced apart from each other by a predetermine interval similarly to the protruding piece 152 (see FIGS. 2 and 6). Also, the fitting indentation 154 is formed such that the protrusion 152 is supported elastically by the two protruding pieces of the fitting indentation with it sandwiched therebetween.

Figure 7A:
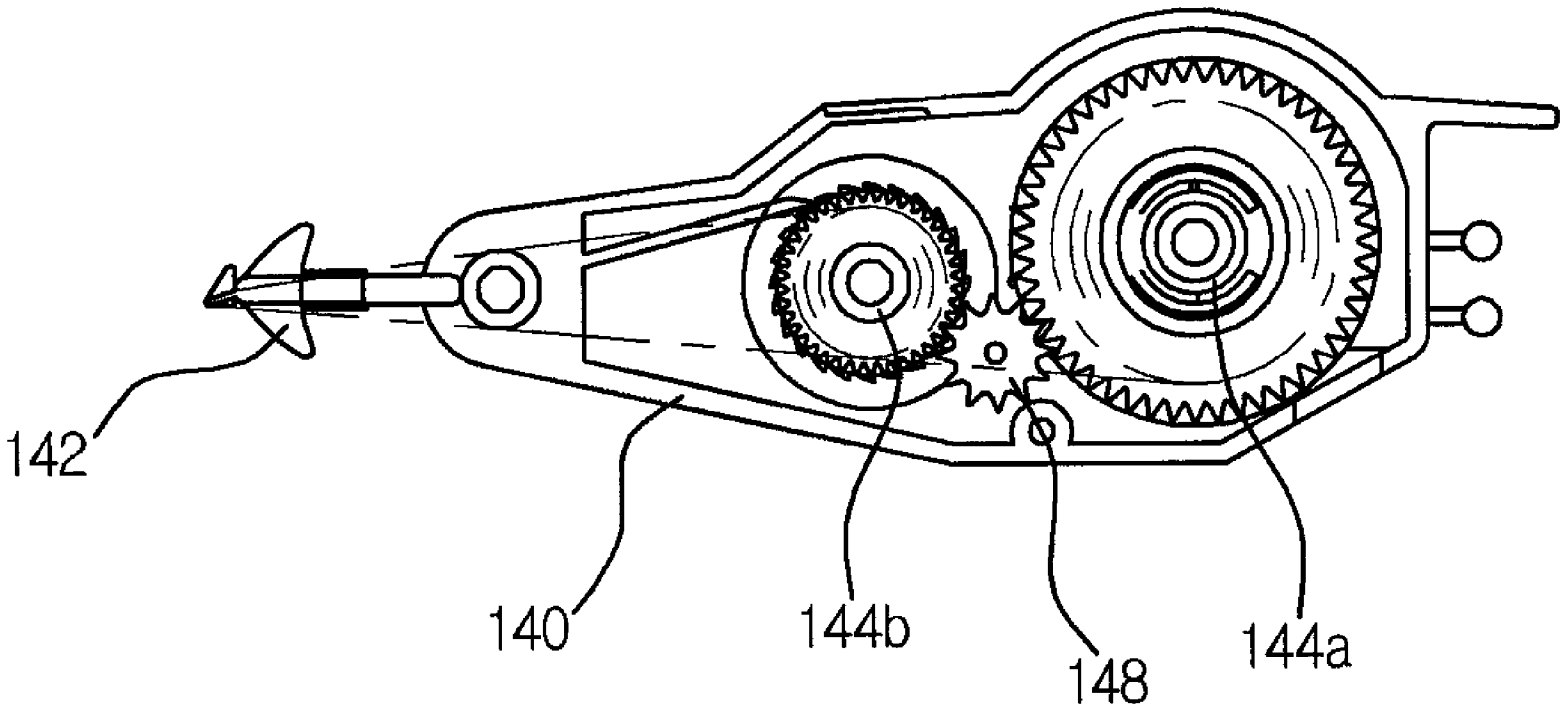
FIG. 7*a* is a cross-sectional photograph illustrating the interior of the tape cartridge 140 shown in FIG. 2 disengaged from the casing.
Figure 7B:
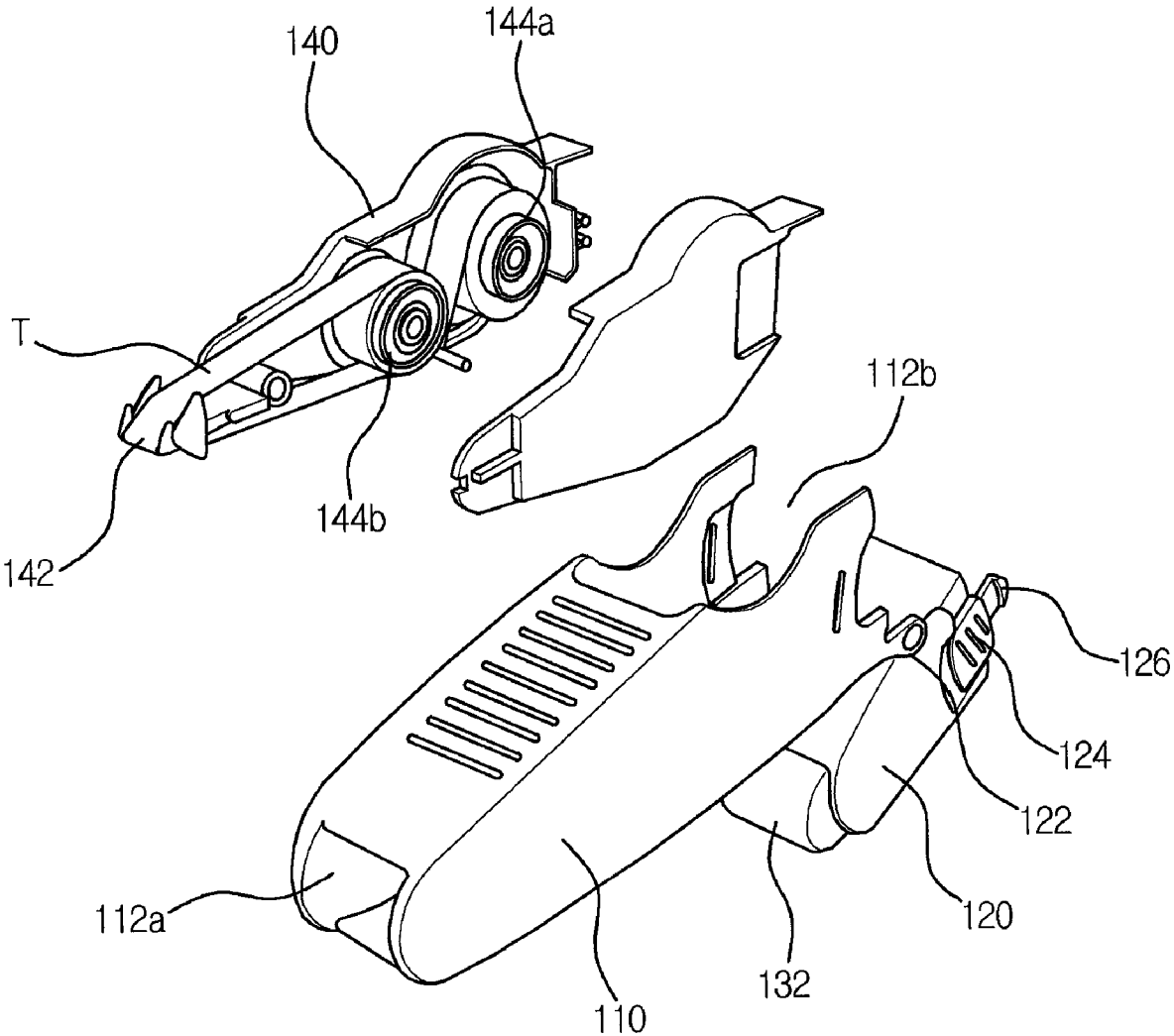
FIG. 7*b* is a photograph illustrating a state where after a cover is pivoted about a hinge shaft of the casing to open the casing, the tape cartridge 140 is completely removably taken out of the casing.
Figure 8A:
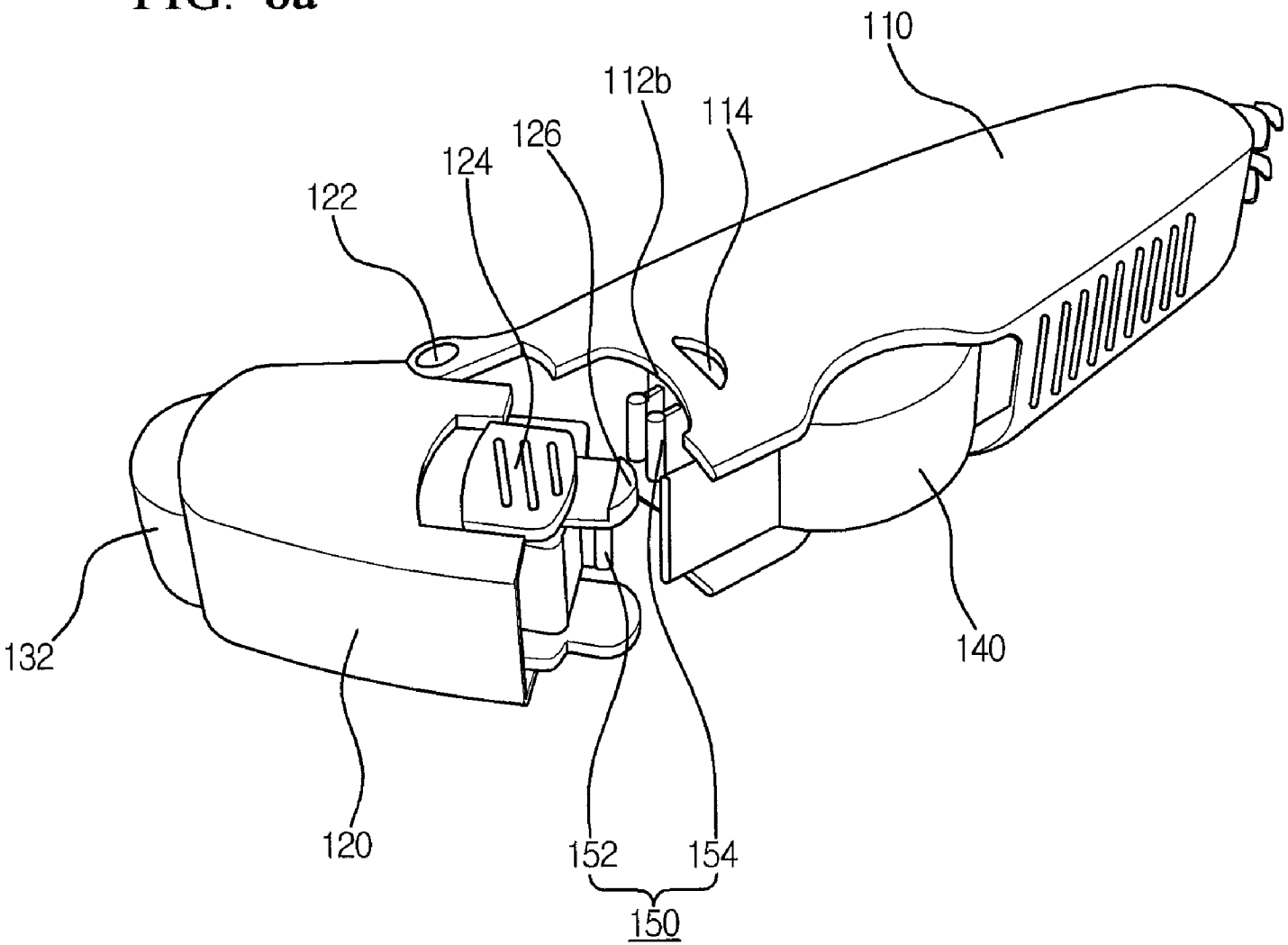
FIGS. 8*a* to 8*d* are photographs illustrating a series of sequential processes where the tape cartridge included in the casing of the correction tape applicator shown in FIG. 1 is replaced with a new one.
Figure 8B:
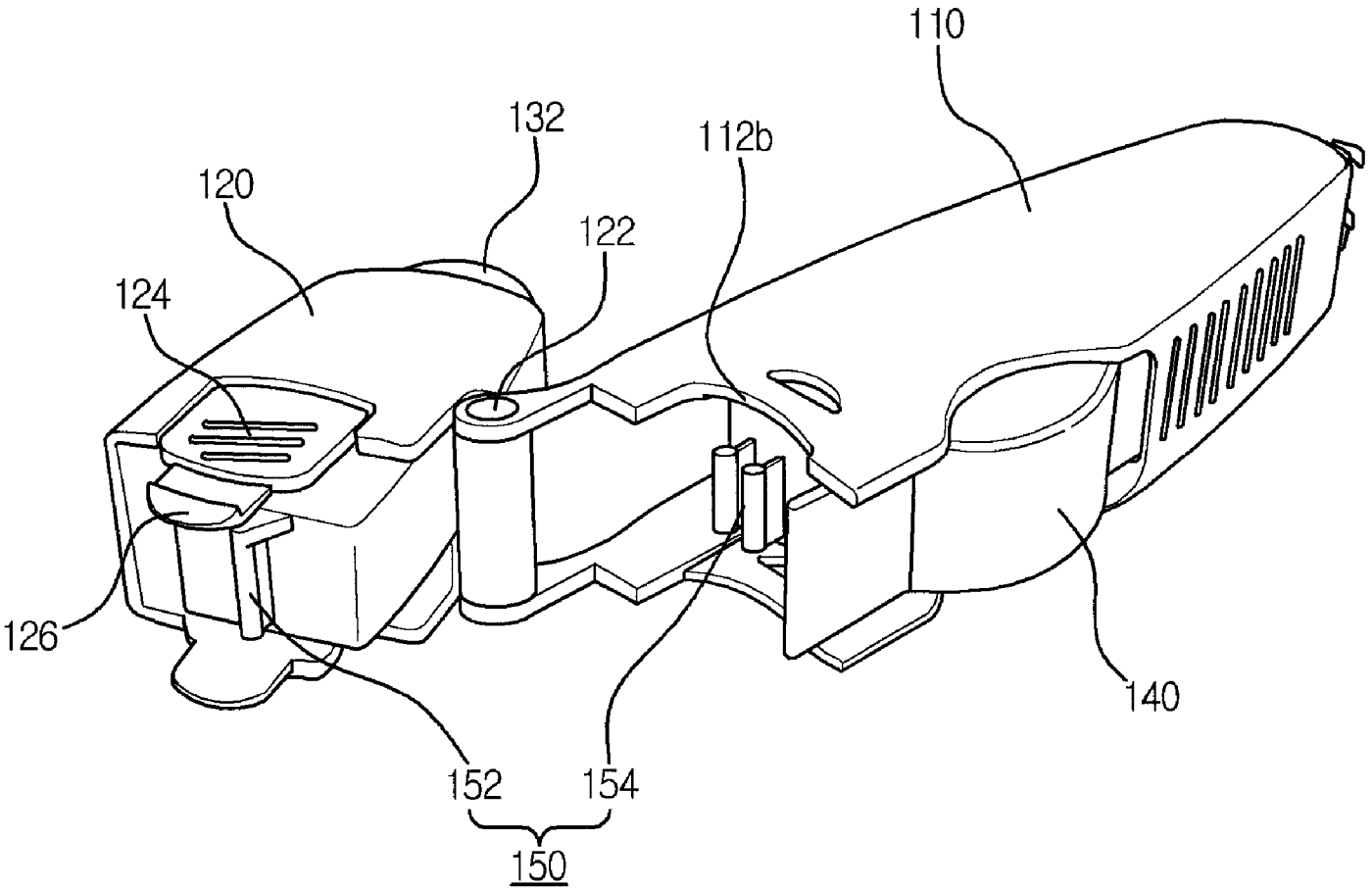
Figure 8C:
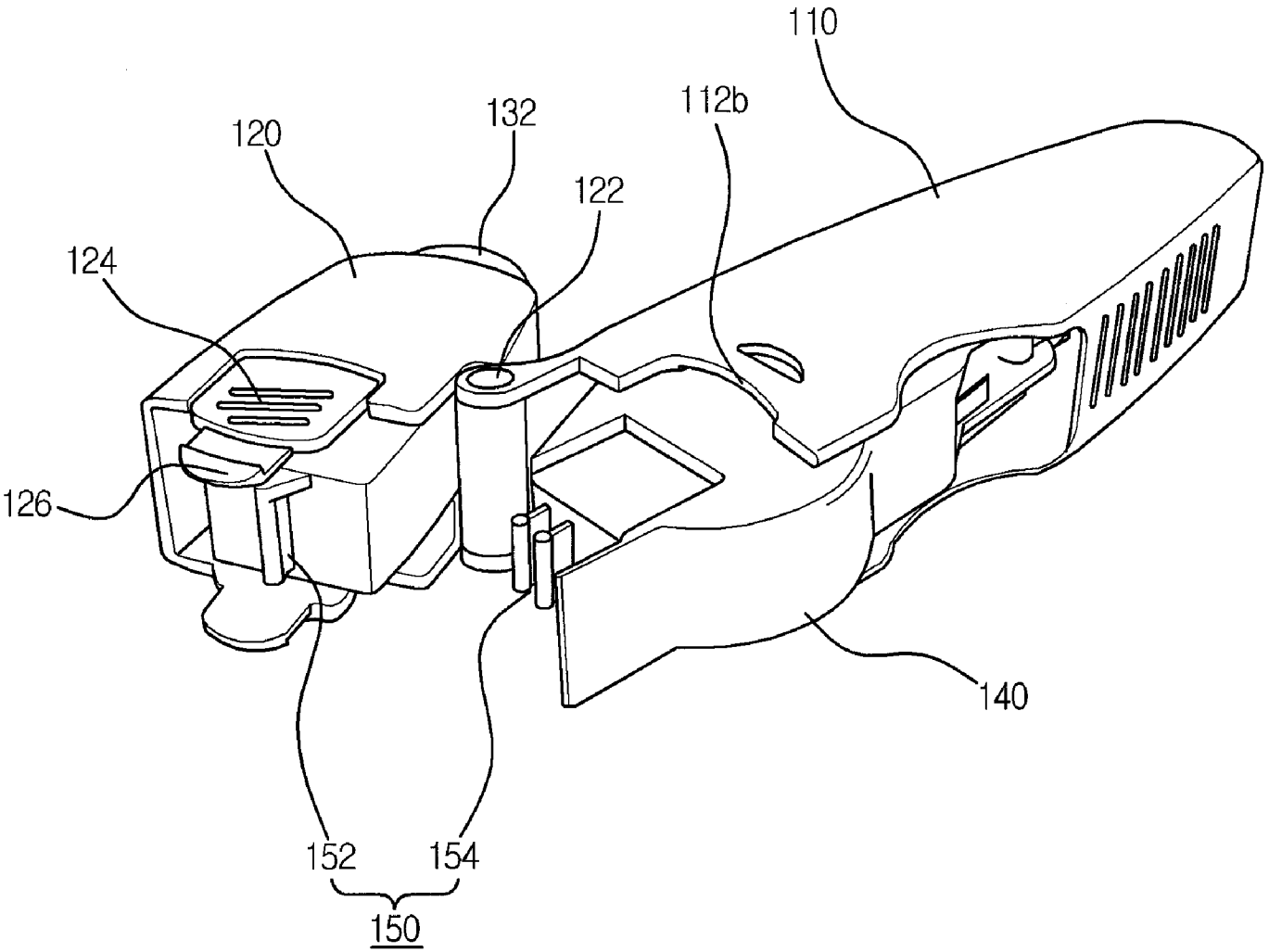
Figure 8D:
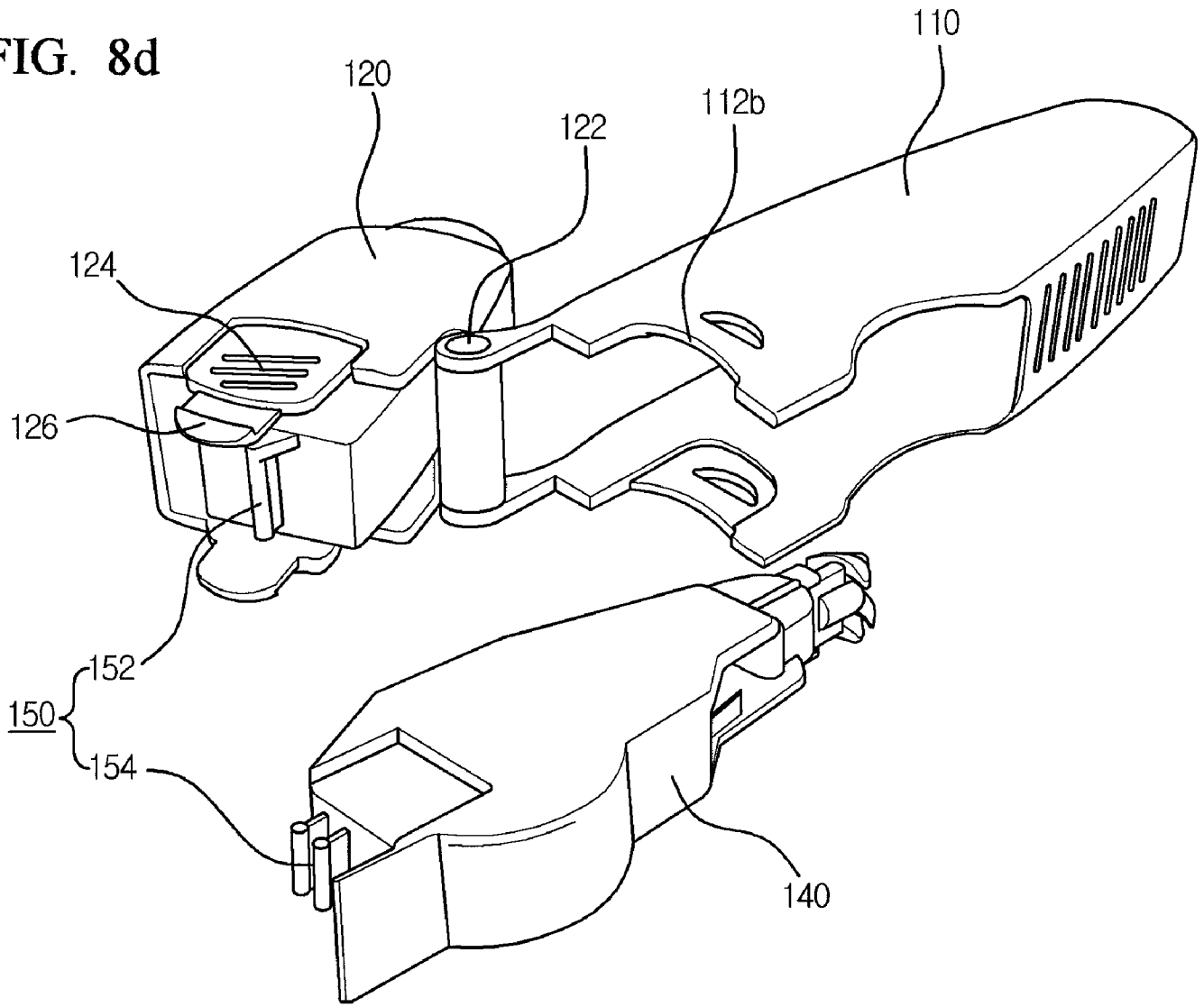

FIG. 7*a* is a cross-sectional photograph illustrating the interior of the tape cartridge 140 shown in FIG. 2 disengaged from the casing, FIG. 7*b* is a photograph illustrating a state where after a cover is pivoted about a hinge shaft of the casing to open the casing, the tape cartridge 140 is completely removably taken out of the casing, and FIGS. 8*a* to 8*d* are photographs illustrating a series of sequential processes where the tape cartridge included in the casing of the correction tape applicator shown in FIG. 1 is replaced with a new one.

As shown in FIGS. 7*a* to 8*d*, the correction tape applicator 100 according to the first embodiment of the present invention can allow the replace the tape cartridge 140 disposed within the main body 110 to be simply and easily replaced with another.

That is, only the tape cartridge 140 can be exchanged to refill the tape cartridge 140 after the correction tape T disposed in the tape cartridge 140 is depleted. To this end, according to the correction tape applicator 100 of the first embodiment of the present invention, a user can disengage the cover 120 from the main body 110 to open the rear opening of the main body 110 in a state of slightly pressing the elastic arms 124 formed at both sides of the cover 120 with his or her fingers. In this case, the cover 120 is openably pivoted by means of the hinge shaft 122 at the rear opening of the main body 110.

In this manner, when the cover 120 is pivoted to be opened, the protrusion 152 and the fitting indentation 154 of the engagement and disengagement means 150 are disengaged from each other so that the tape cartridge 140 can be easily removed from the main body 110 so as to be replaced with a new one. At this time, when the new tape cartridge is inserted into the rear opening of the main body 110 and then the cover 120 is closably pivoted, the protrusion 152 and the fitting indentation 154 of the engagement and disengagement means 150 are fittingly engaged with each other so that the tape cartridge 140 and the knock member 134 are coupled to each other so as to stably support the tape cartridge 140 disposed in the main body 110 (see FIGS. 8*a* to 8*d*).

Figure 9A:
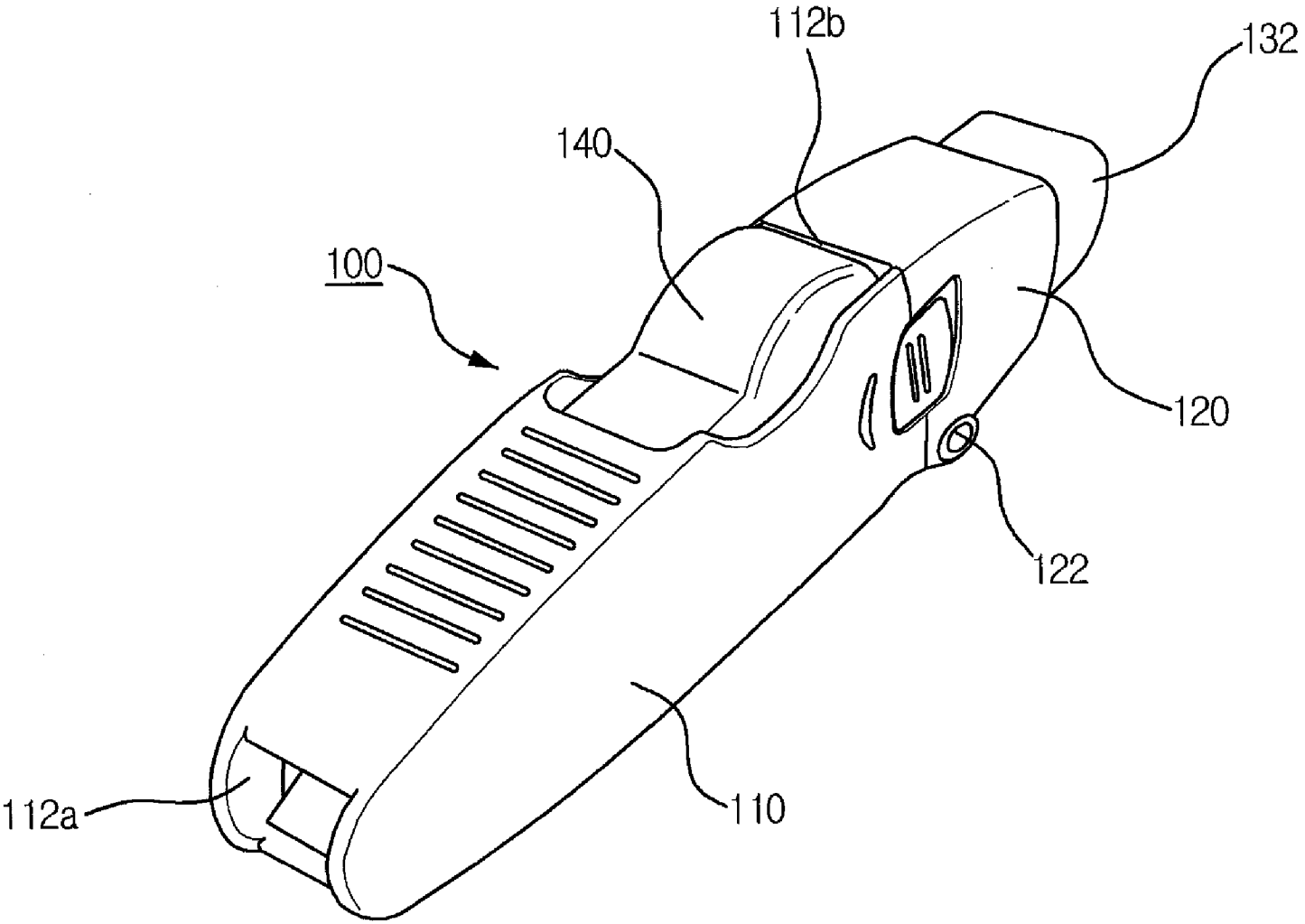
FIG. 9*a* is a perspective photograph illustrating a state where a guide tip 142 of the correction tape applicator shown in FIG. 1 is retracted into a front end of the casing so that the correction tape applicator is not in use.
Figure 9B:
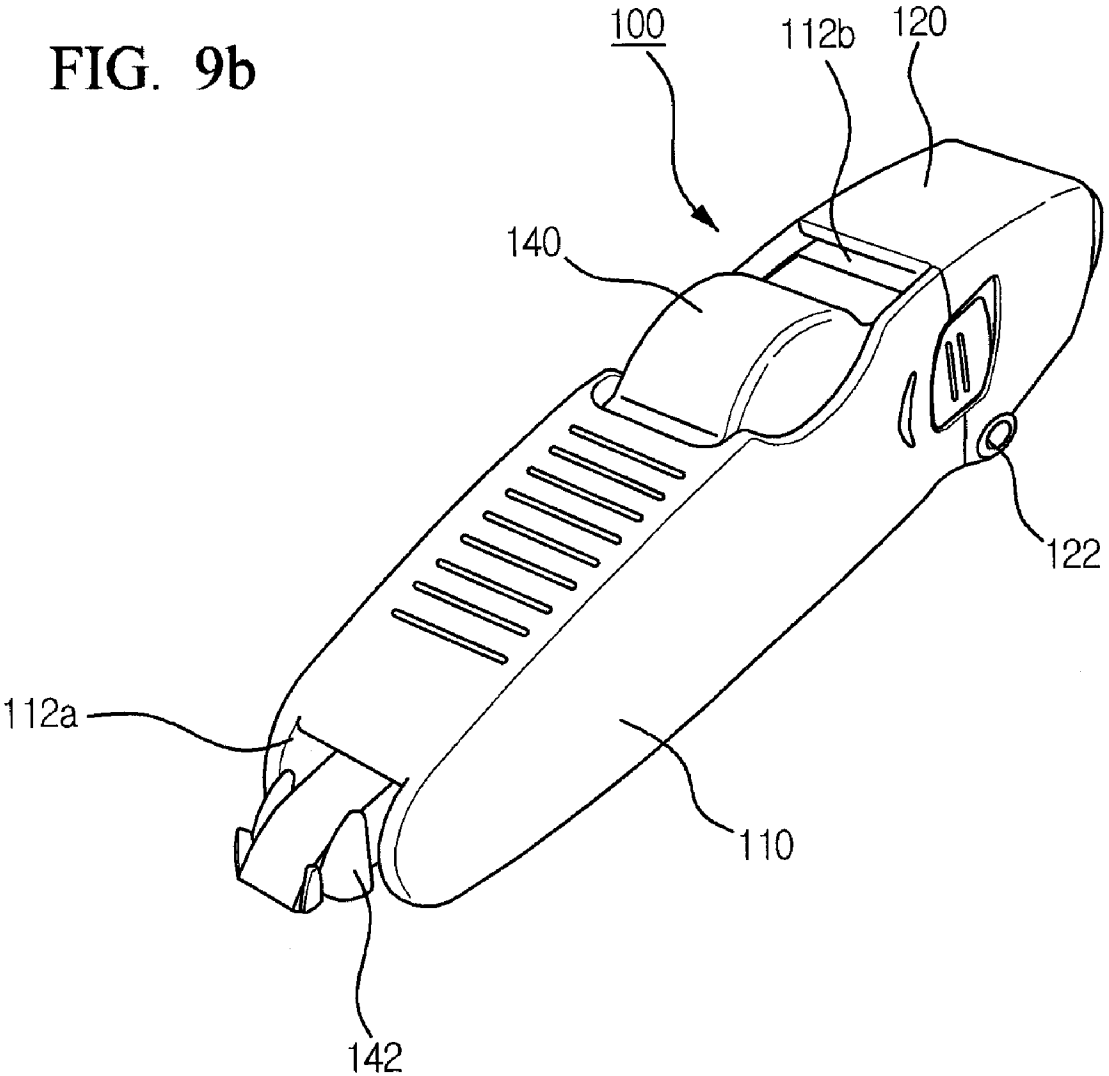
FIG. 9*b* is a perspective photograph illustrating a state where the guide tip 142 shown in FIG. 9*a* is protrudingly advanced from the front end of the casing so that the correction tape applicator is in use.

FIG. 9*a* is a perspective photograph illustrating a state where a guide tip 142 of the correction tape applicator shown in FIG. 1 is retracted into a front end of the casing so that the correction tape applicator is not in use, and FIG. 9*b* is a perspective photograph illustrating a state where the guide tip 142 shown in FIG. 9*a* is protrudingly advanced from the front end of the casing so that the correction tape applicator is in use.

As shown in FIG. 9*a* when the correction tape applicator 100 according to the first embodiment of the present invention is not in use, the guide tip 142 formed at the front end of the tape cartridge 140 can be retracted into the front opening 112*a* as the withdrawal opening formed at the main body 110 so as to be kept in custody in the main body 110.

On the contrarily, as shown in FIG. 9*b*, when the correction tape applicator 100 is in use, the guide tip 142 of the tape cartridge 140 can be protrudingly advanced from the front opening 112*a* as the withdrawal opening formed at the main body 110 so as to be used.

The cover 120 opened for the sake of maintenance or replacement of the tape cartridge 140 is pivoted in one direction about the hinge shaft 122 so as to be opened so that the opening/closing operation of the cover 120 and the replacement of the tape cartridge 140 can be conveniently performed.

Particularly, the present invention allows the tape cartridge 140 and the knock member 134 of the pressing means 130 to be integrally coupled with each other by the engagement and disengagement means 150 after the replacement of the tape cartridge 140 so that the tape cartridge 140 mounted in the main body 110 can be operated while being more stably supported.

Figure 10:
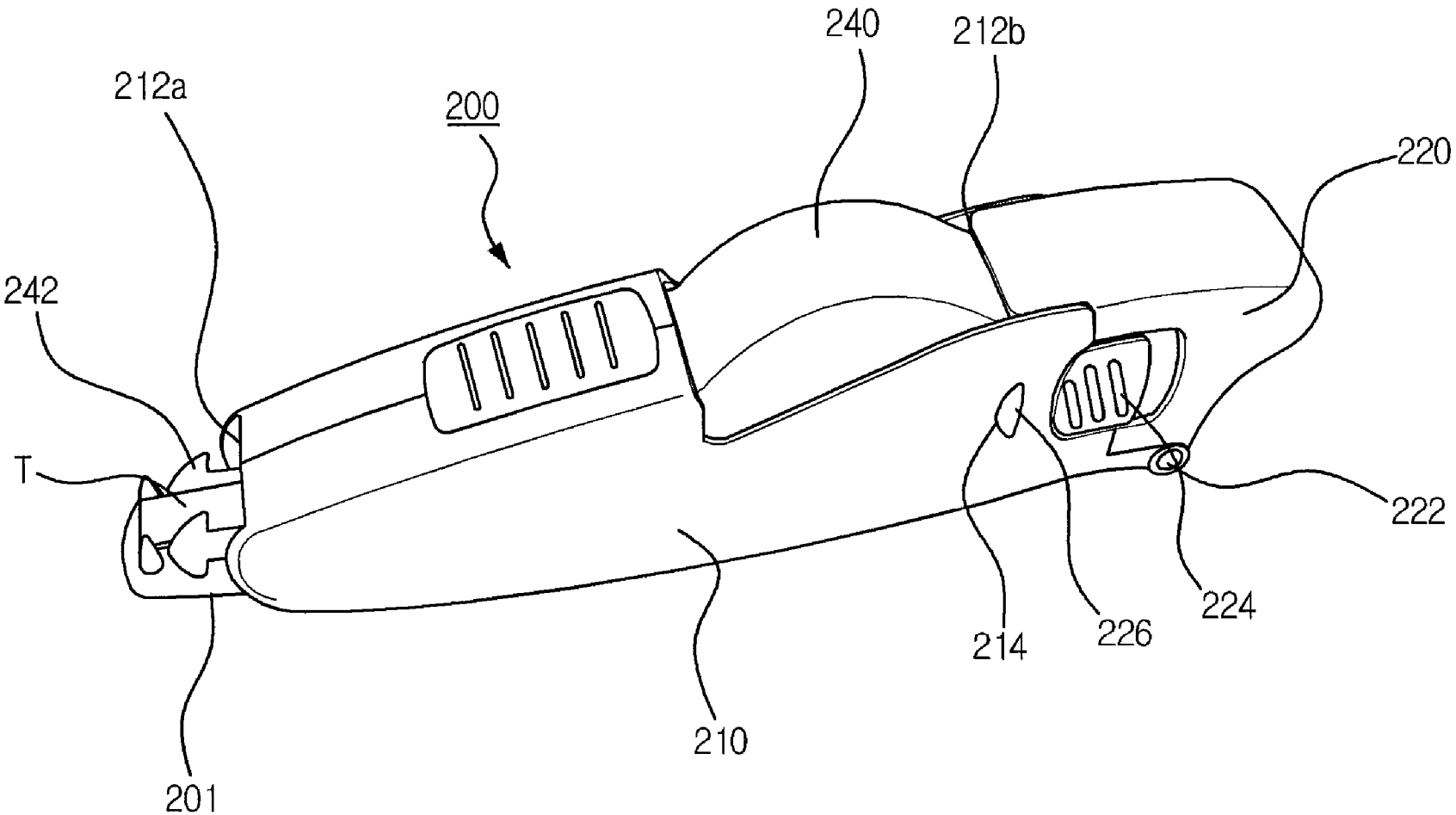
FIG. 10 is a perspective photograph illustrating a correction tape applicator according to a second embodiment of the present invention.
Figure 11:
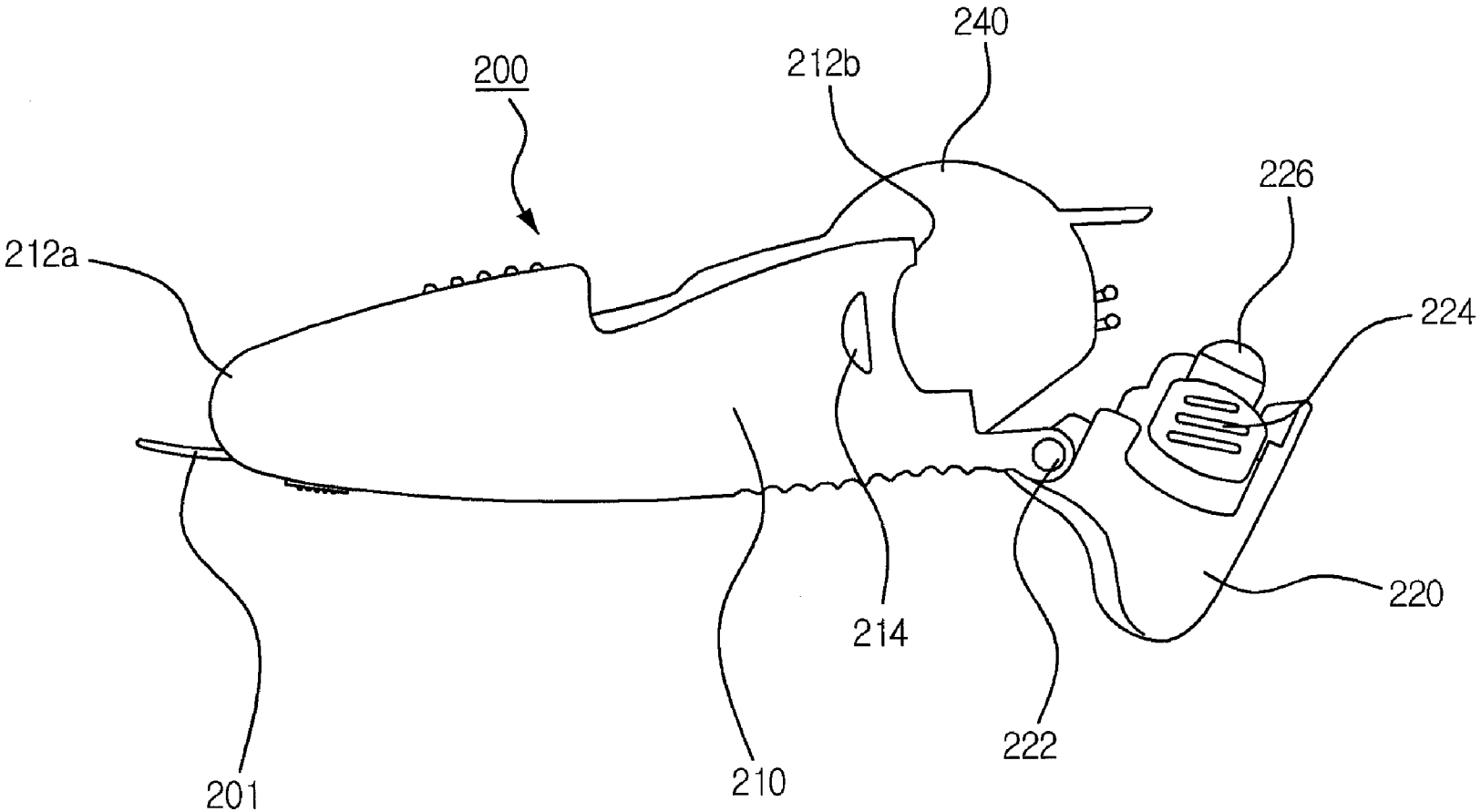
FIG. 11 is a perspective photograph illustrating a state where a cover is opened to replace the tape cartridge included in the casing of the correction tape applicator shown in FIG. 10 with a new one.
Figure 12:
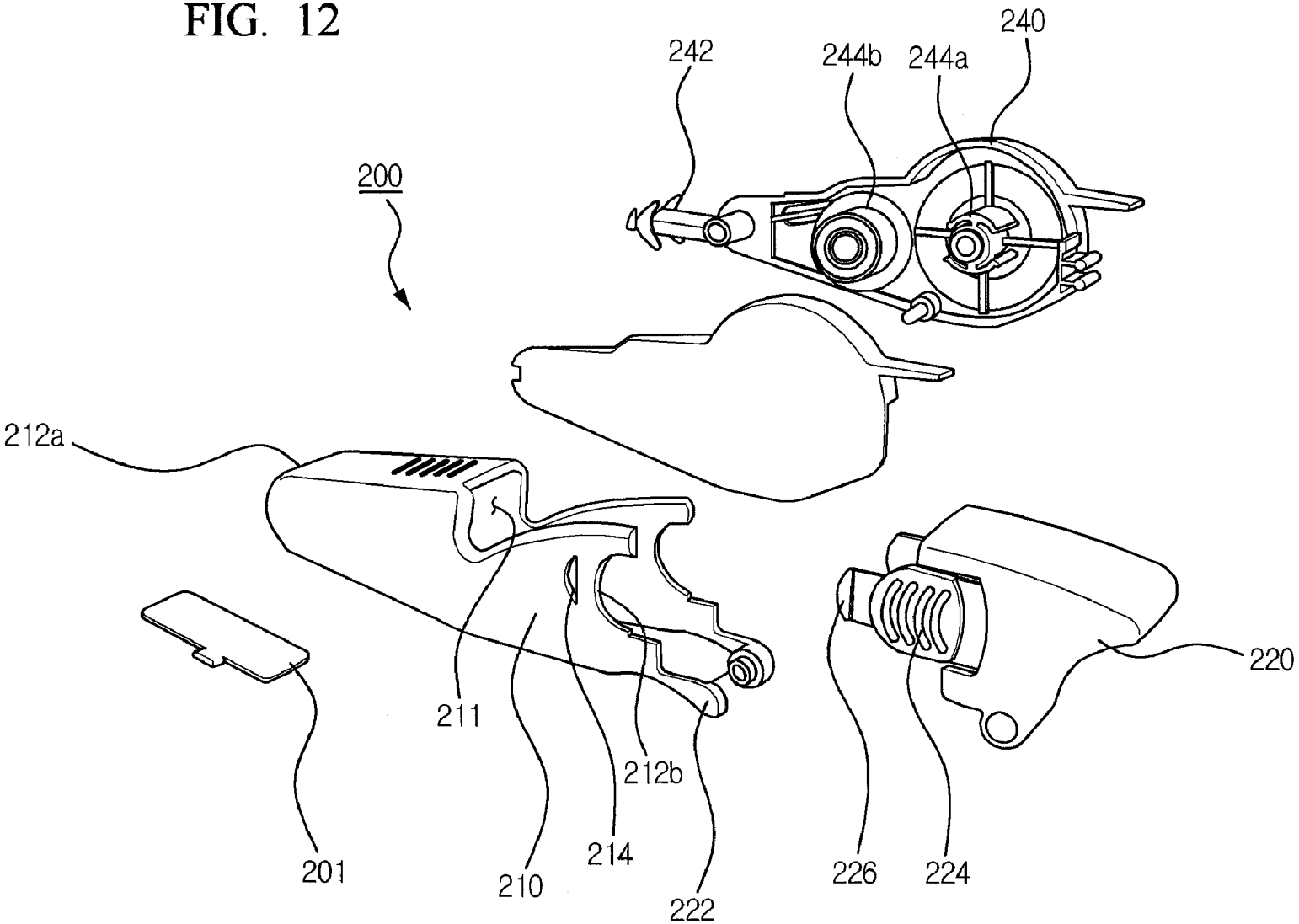
FIG. 12 is a photograph illustrating a state where after a cover is removed from the casing body, the tape cartridge 240 is completely taken out of the casing so that elements of the correction tape applicator are dissembled.
Figure 13:
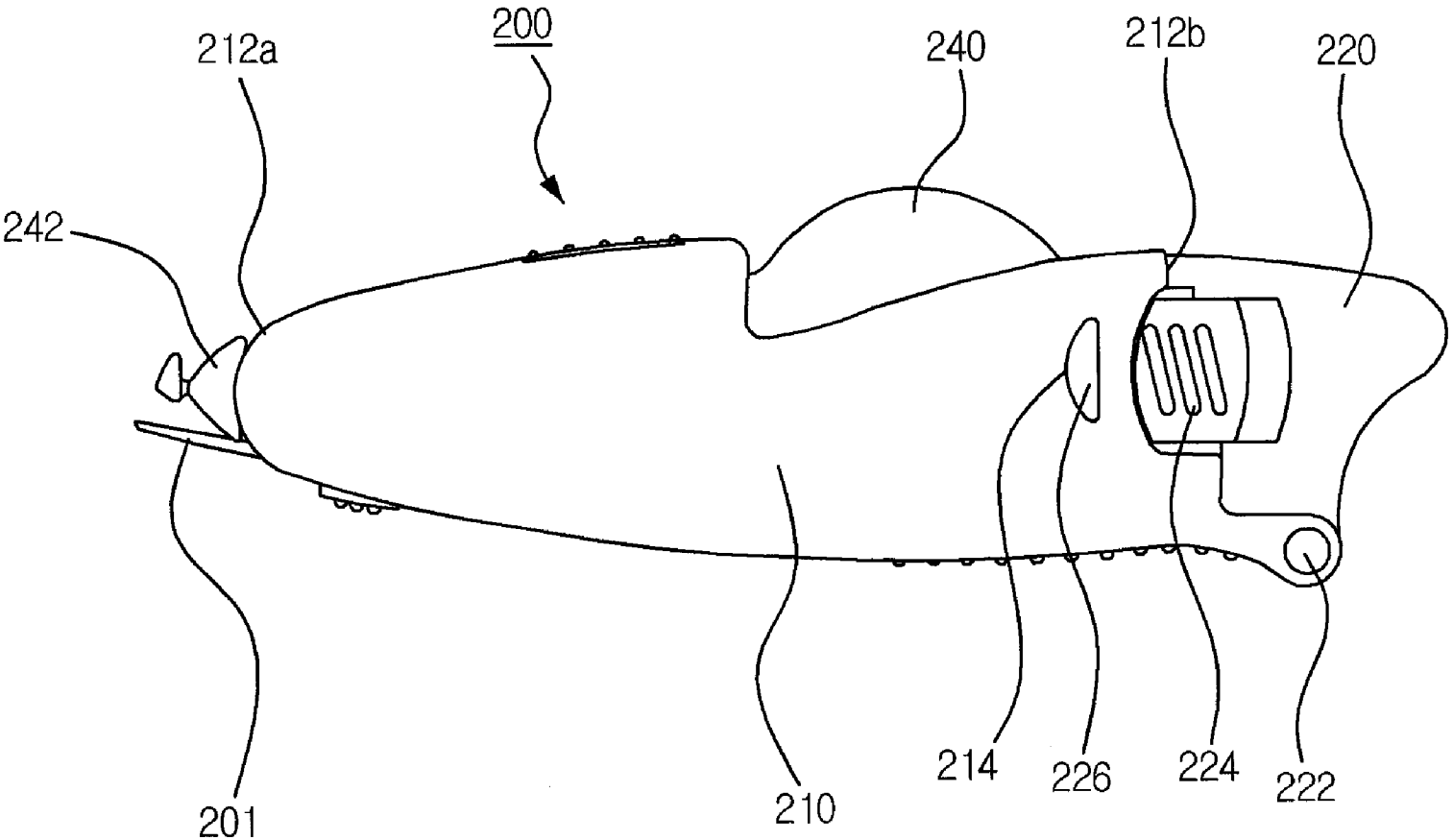
FIG. 13 is a photograph illustrating a state where a protective piece 201 installed so as to be advanced and retracted below the guide tip 242 of the correction tape applicator shown in FIG. 10 is protruded from the front end of the casing.

FIG. 10 is a perspective photograph illustrating a correction tape applicator according to a second embodiment of the present invention, FIG. 11 is a perspective photograph illustrating a state where a cover is opened to replace the tape cartridge included in the casing of the correction tape applicator shown in FIG. 10 with a new one, FIG. 12 is a photograph illustrating a state where after a cover is removed from the casing body, the tape cartridge 240 is completely taken out of the casing so that elements of the correction tape applicator are dissembled, and FIG. 13 is a photograph illustrating a state where a protective piece 201 installed so as to be advanced and retracted below the guide tip 242 of the correction tape applicator shown in FIG. 10 is protruded from the front end of the casing.

As shown in FIGS. 10 to 13, a correction tape applicator 200 according to the second embodiment of the present invention includes a casing. The casing consists of a main body 210 and a cover 220. The main body 210 internally defines an internal space portion 211 for accommodating a tape cartridge 240 in which a carrier tape T coated with a coating material is wound. The carrier tape T is formed in various sizes. The main body 210 has front and rear openings 212*a* and 212*b* formed at the front and rear ends thereof so as to allow the internal space portion 211 to fluidically communicate with the outside. The front opening 212*a* is used as a withdrawal opening for allowing a guide tip 242 formed at a front end of the tape cartridge 240 disposed within the main body 10 to be externally protruded therethrough. Also, the rear opening 212*b* is used as an insertion opening for allowing the tape cartridge 240 to be inserted into the internal space portion 211 therethrough.

In addition, the cover 220 is pivotally mounted to a rear end of the main body 210 by means of a hinge shaft 222 so as to open and close the rear opening 212*b* of the main body 210.

As shown in the drawings, the correction tape applicator 200 according to the second embodiment of the present invention includes an engagement means. The engagement means is intended to allow the cover 220 to be easily disengaged from and engaged with the main body 210. The engagement means includes a pair of opposed engagement apertures 214 formed at the main body 210 and a pair of opposed engagement lugs 226 formed at the cover 220 so as to be lockingly engaged with the engagement apertures 214. The engagement lugs 226 are formed at front ends of a pair of opposed elastic arms 224 formed at the cover 220.

The engagement apertures 214 are formed at the right and left both surfaces of the main body 210 so that the cover 220 disposed at the rear opening 212*b* is securely engaged with the main body 210 by the engagement apertures 214.

Moreover, the elastic arms 224 are formed at both sides of the cover 220 so that the cover 220 can be easily disengaged from and engaged with the main body 210. The engagement lugs 226 are formed at front ends of the elastic arms 224 so as to allow the engagement lugs to be lockingly engaged with the engagement apertures 214 formed at the both sides of the main body 210 so that the cover 220 and the main body 210 are securely engaged with each other.

As shown in the drawings, the correction tape applicator 200 according to the second embodiment of the present invention includes a tape cartridge 240. The tape cartridge 140 is mounted in the internal space portion 211 of the main body 210 so that a guide tip 242 formed at a front end of the tape cartridge 240 can be protruded through the front opening 212*a*. That is, the tape cartridge 240 is constructed such that it is inserted into the internal space portion 211 of the main body 210 through the rear opening 212*b* of the main body 210 so that only the guide tip 242 of the tape cartridge 240 is protruded through the front opening 212*a* of the main body.

A carrier tape coated with a coating material (adhesive material or correction fluid) is disposed within the tape cartridge 240 such that it is traveled on the guide tip 242 via a predetermined path of travel. That is, mounted within the tape cartridge 240 are a first spool 244*a* as a supply spool on which a unused opaque carrier tape T is wound and a second spool 244*b* as a return spool on which a used transparent carrier tape T is wound. The tape cartridge 240 has the same construction as that of the tape cartridge 140 as mentioned above, and thus its detailed description will be omitted to avoid redundancy.

As shown in the drawings, the correction tape applicator 200 according to the second embodiment of the present invention includes a protective piece 201 mounted at a front end of the main body 210 in an advancing and retracting manner. The protective piece 201 is mounted at one side of the main body 210 in such a fashion as to be advanced from and retracted into the main body through the front opening 212*a* so as to protect the carrier tape T coated with a coating material, which is traveled on the guide tip 242 while being externally exposed from the main body 210. That is, the protective piece 201 is advanced from and retracted into the main body 210 in proximity to the guide tip 242 of the tape cartridge 240, which is protruded from the front end of the main body 210, so as to closely cover the carrier tape T positioned on the guide tip 242 to thereby protect the coating material coated on the carrier tape T and prevent an adhesive component contained in the coating material from being hardened.

When the correction tape applicator 200 according to the second embodiment of the present invention is not in use, the protective piece 201 is protrudingly advanced from the front end of the main body 210 so as to closely cover the carrier tape T to thereby protect the coating material coated on the carrier tape T. On the other hand, when the correction tape applicator 200 is in use, the protective piece 201 is retracted into the main body 210 through the front opening 212*a* so as to use the coating material-coated carrier tape T.

The correction tape applicator 200 according to the second embodiment of the present invention enables the tape cartridge 240 mounted in the main body 210 to be easily and simply exchanged. That is, when the carrier tape T disposed in tape cartridge 240 is depleted, only the tape cartridge 240 can be replaced with a new one for the purpose of refilling.

To this end, according to the correction tape applicator 200 of the second embodiment of the present invention, a user can disengage the cover 220 from the main body 210 to open the rear opening of the main body 210 in a state of slightly pressing the elastic arms 224 formed at both sides of the cover 220 with his or her fingers. In this case, the cover 220 is openably pivoted by means of the hinge shaft 222 at the rear opening of the main body 210.

In this manner, when the cover 220 is pivoted to be opened, so that the tape cartridge 240 can be easily removed from the main body 210 so as to be replaced with a new one. At this time, when the new tape cartridge is inserted into the rear opening of the main body 210 and then the cover 220 is closably pivoted, the engagement lugs 226 are lockingly engaged with the engagement apertures 214 so that the cover 220 and the main body 210 are securely engaged with each other to thereby stably support the tape cartridge 240 disposed in the main body 210.

Further, when the correction tape applicator 200 according to the second embodiment of the present invention is not in use, the protective piece 201 is protrudingly advanced from the front end of the main body 210 in proximity to the guide tip 242 of the tape cartridge 240 so as to closely cover the carrier tape T positioned on the guide tip 242 to thereby protect the coating material coated on the carrier tape T and prevent an adhesive component contained in the coating material from being hardened so that the correction tape applicator can be in a state of being kept in custody (see FIGS. 10 and 13). On the other hand, when the correction tape applicator 200 is in use, the protective piece 201 is retracted into the main body 210 through the front opening 212*a* so as to use the coating material-coated carrier tape T.

The cover 220 opened for the sake of maintenance or replacement of the tape cartridge 240 is pivoted in one direction about the hinge shaft 222 so as to be opened so that the opening/closing operation of the cover 220 and the replacement of the tape cartridge 240 can be conveniently performed.

As described above, the present invention has the following advantageous effects.

A tape cartridge directly applied to the application work is completely protectively accommodated within a casing so as to eliminate a problem in that the correction tape applicator cannot be used for a long time period due to adhesion of foreign substances to the surface of the externally exposed coating material of the carrier tape and deformation of the coating material, thereby improving durability to achieve economic efficiency.

In addition, the tape cartridge can be easily disengaged from and engaged with the casing to enhance convenience of use so that anyone can easily replace the used tape cartridge with a new one.

Furthermore, an opening/closing space of a cover can be minimized to reduce the dimension of the casing, leading to a reduction in the manufacturing cost.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A correction tape applicator comprising:

a casing including a hollow main body and a cover, the main body having an internal space portion of a predetermined dimension, the main body being opened at both ends thereof to form front and rear openings so as to allow the internal space portion to fluidically communicate with the outside, and the cover having an internal space portion, the cover being opened at both ends thereof and being pivotally hinged to one end of the main body so as to open and close the rear opening formed at the one end of the main body;

a tape cartridge removably accommodated in the internal space portion of the main body, the tape cartridge including at least two spools for winding a unused carrier tape coated with a coating material to be applied to a to-be-applied surface so that the carrier tape can be withdrawn and a used carrier tape not coated with the coating material, and a plurality of gears for driving the spools;

pressing means adapted to be movably inserted into the internal space portion of the casing cover by means of an elastic force of elastic members so that the pressing means is connected at one end thereof to a rear end of the tape cartridge and is externally protruded from the casing cover at the other end thereof in such a fashion as to be pressed, the pressing means being adapted to impart a force necessary for allowing a part of the tape cartridge to be externally protruded from the front opening of the main body so that the coating material of the carrier tape can be applied to the to-be-applied surface or allowing the tape cartridge to return to its original position of the internal space portion of the casing depending on whether or not the externally protruded portion of the pressing means is pressed; and engagement and disengagement means mounted at the opposed confronting ends of the pressing means and the tape cartridge so as to allow the pressing means and the tape cartridge to be releasably and fittingly engaged with each other therethrough such that the pressing means and the tape cartridge are disengaged from each other or engaged with each other depending on whether the casing cover is opened or closed, wherein the engagement and disengagement means comprises: a protrusion formed on one end surface of the opposed confronting ends of the pressing means and the tape cartridge in such a fashion as to be formed as a protruding piece having a round shape in the cross-section at a distal end thereof; and a fitting indentation formed on the other end surface of the opposed confronting ends of the pressing means and the tape cartridge in such a fashion as to be defined by a pair of opposed protruding pieces formed in a round shape in the cross-section at distal ends thereof so as to be spaced apart from each other by a predetermine interval to thereby elastically support the protrusion, such that the protrusion is disengaged from or engaged with the fitting indentation depending on whether the casing cover is opened or closed.

2. The correction tape applicator according to claim 1, wherein the tape cartridge comprises a housing having a body composed of two half-bodies for accommodating the two spools therein, and a guide tip disposed at a front end of the housing for providing a path of travel of the carrier tape.

3. The correction tape applicator according to claim 1, wherein the coating material of the carrier tape is any one of an adhesive material for adhering sheets of paper to each other or a correction fluid for correcting markings such as characters and the like recorded on a sheet of paper.

* * * * *